US006764028B2

(12) United States Patent
Mills et al.

(10) Patent No.: US 6,764,028 B2
(45) Date of Patent: Jul. 20, 2004

(54) FUEL INJECTOR NOZZLES

(75) Inventors: John Richard Mills, Williamsburg, VA (US); Jordi J. Catasus-Servia, Williamsburg, VA (US); Daniel P. Sweeney, Gloucester, VA (US)

(73) Assignee: Synerject, LLC, Newport News, VA (US)

( * ) Notice: Subject to any disclaimer, the term of this patent is extended or adjusted under 35 U.S.C. 154(b) by 0 days.

(21) Appl. No.: 09/824,785

(22) Filed: Apr. 4, 2001

(65) Prior Publication Data

US 2002/0145060 A1 Oct. 10, 2002

(51) Int. Cl.[7] ..... F02M 61/08; B05B 1/30

(52) U.S. Cl. ..... 239/533.7; 239/585.1; 239/585.4; 239/585.5; 239/533.3

(58) Field of Search ..... 239/587, 585.1, 239/585.4, 533.2, 533.7, 568, 533.3, 88–92, 585.2, 585.3, 585.5, 533.9; 251/127, 129.15, 129.21

(56) References Cited

U.S. PATENT DOCUMENTS

| | | | | | |
|---|---|---|---|---|---|
| 2,044,522 | A | * | 6/1936 | Wurtele | 123/32 |
| 2,295,081 | A | * | 9/1942 | Harvath | 239/533.7 |
| 4,339,080 | A | * | 7/1982 | Kopse | 239/533.3 |
| 4,381,077 | A | | 4/1983 | Tsumura | |
| 4,434,766 | A | | 3/1984 | Matsuoka et al. | |
| 4,502,196 | A | | 3/1985 | Kupper et al. | |
| 4,758,169 | A | | 7/1988 | Steiger | |
| 4,909,444 | A | * | 3/1990 | Sczomak | 239/453 |
| 4,934,329 | A | | 6/1990 | Lear et al. | |
| 5,090,625 | A | | 2/1992 | Davis | |
| 5,127,584 | A | * | 7/1992 | Sczomak | 239/533.11 |
| 5,199,398 | A | * | 4/1993 | Nylund | 123/299 |
| 5,546,902 | A | | 8/1996 | Paluch et al. | |
| 5,551,638 | A | | 9/1996 | Caley | |
| 5,590,635 | A | | 1/1997 | Piock et al. | |
| 5,593,095 | A | | 1/1997 | Davis et al. | |
| 5,632,253 | A | | 5/1997 | Paul et al. | |
| 5,833,142 | A | | 11/1998 | Caley | |
| 5,884,611 | A | * | 3/1999 | Tarr et al. | 123/531 |
| 5,983,865 | A | | 11/1999 | Yamashita et al. | |
| 6,085,719 | A | | 7/2000 | Heinz et al. | |
| 6,095,111 | A | | 8/2000 | Ueda et al. | |
| 6,131,607 | A | | 10/2000 | Cooke | |

FOREIGN PATENT DOCUMENTS

| | | |
|---|---|---|
| SU | 1740752 A1 | 6/1992 |
| WO | WO 89/04920 A1 | 6/1989 |
| WO | WO 01/77518 A1 | 10/2001 |

OTHER PUBLICATIONS

Orbital Direct Injection, A Technology Update from the Orbital Engine Corporation, Mar. 2000, 4 Pages.

Derwent Abstract Accession No. 93–194705/24, Class Q53, SU 1740752 A1 (Fuel Equip Sci Prodn Assoc) 15 Jun. 1992 Abstract.

* cited by examiner

*Primary Examiner*—Davis Hwu
(74) *Attorney, Agent, or Firm*—Cooley Godward LLP

(57) ABSTRACT

A poppet for a fuel injector having a head with one or more ducts that help reduce the formation of deposits on the head.

52 Claims, 11 Drawing Sheets

FUEL INJECTOR NOZZLES

BACKGROUND OF THE INVENTION

1. Field of the Invention

The present invention relates to nozzles for fuel injectors, and more particularly to the poppets of such nozzles.

2. Description of the Related Art

Because the shape and direction of the plume of fuel exiting fuel injectors influences the efficiency of fuel combustion, some conventional fuel injectors include features that affect the shape and direction of the exiting plume. For example, some conventional fuel injectors include a projection that extends beyond the extremity of the exit of the fuel injectors, i.e., downstream of a valve seat of the fuel injectors. The exiting plume generally follows a path defined by the external surface of the projection. In this manner, the shape and direction of the exiting plume may be controlled.

Although such projections generally control the shape and direction of the plume, irregular deposits tend to form on the surface of the projection. For example, carbon and other combustion related deposits tend to form on the surface of the projection at a location immediately downstream of the valve seat of the fuel injectors. These deposits affect the flow of the plume over the projection and thus adversely affect the shape of the plume. If the fuel injector acts as a fuel metering device, these deposits may also adversely affect the quantity of metered fuel. Some conventional fuel injectors include features that tend to reduce the development of deposits, such as a necked portion and a hollowed-out projection. One benefit of these features is that they reduce the area through which heat in the projection can dissipate to the remainder of the air assist fuel injector and thus help maintain the projection at a sufficiently high temperature to burn off carbon and other deposits on the projection. Despite the relative successes of the above-noted configurations, some amount of deposits still form on the projections, especially at lower fueling levels and/or cooler combustion temperatures.

SUMMARY OF THE INVENTION

In light of the above-described problems associated with the delivery of fuel from conventional fuel injectors, the embodiments of the present invention strive to provide poppets for fuel injectors that are less susceptible to deposit formation.

Other objects, advantages and features associated with the embodiments of the present invention will become more readily apparent to those skilled in the art from the following detailed description. As will be realized, the invention is capable of other and different embodiments, and its several details are capable of modification in various obvious aspects, all without departing from the invention. Accordingly, the drawings in the description are to be regarded as illustrative in nature, and not limitative.

DESCRIPTION OF SPECIFIC EMBODIMENTS

Figure 1:
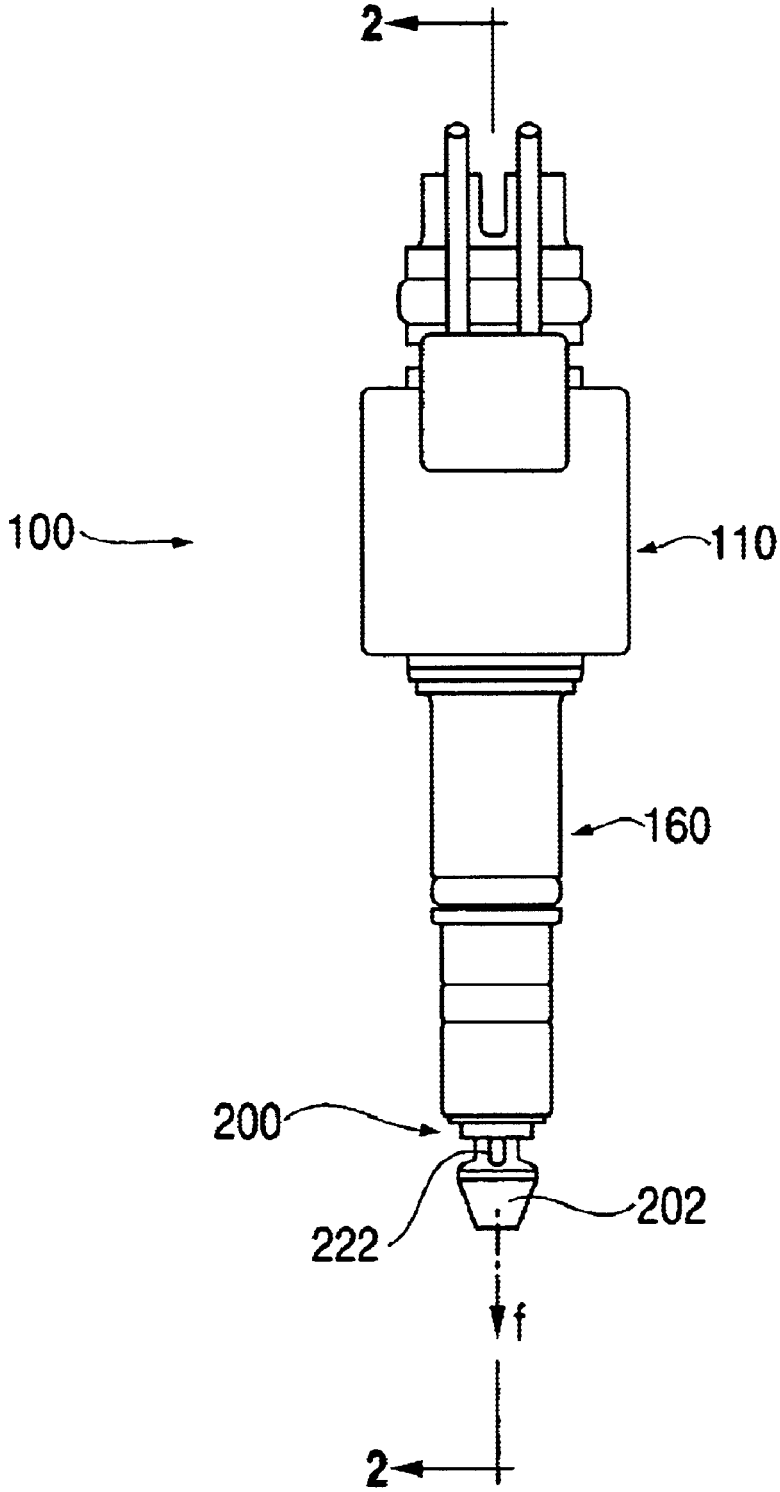
FIG. 1 is a side view of an air assist fuel injector having a fuel injector nozzle and poppet in accordance with embodiments of the present invention.
Figure 2:
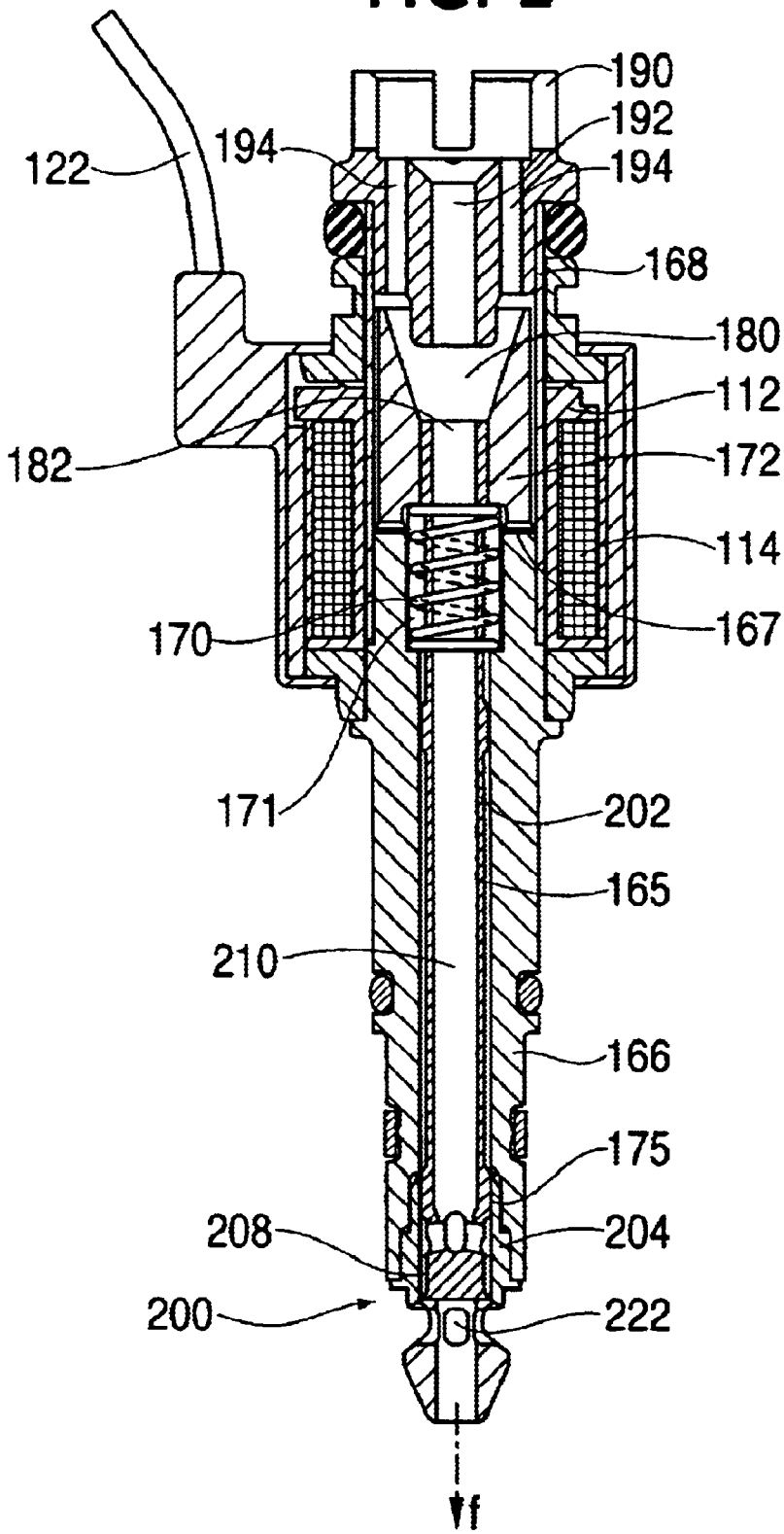
FIG. 2 is a cross-sectional view of the air assist fuel injector illustrated in FIG. 1 taken along the line 2—2 in FIG. 1.

The FIGS. 1 and 2 illustrate one embodiment of an air assist fuel injector 100 having a fuel injector nozzle 200 and poppet 202 according to embodiments of the present invention. The air assist fuel injector 100 is configured for use with a four-stroke internal combustion engine. However, alternative embodiments of the air assist fuel injector 100 are configured for operation with other engines. For example, the air assist fuel injector may be configured for operation with a two stroke internal combustion engine. The air assist fuel injector 100 is configured to utilize pressurized gas to atomize low pressure liquid fuel, which together travel through the air assist fuel injector 100 along a direction of flow f as indicated in FIGS. 1 and 2. The air assist fuel injector 100 includes two primary assemblies: an actuator assembly 110 and a valve assembly 160.

The actuator assembly 110 includes a solenoid coil 114 of conductive wire wrapped around a tubular bobbin 112. The solenoid coil 114 has two ends that are each electrically connected to terminals 122. The solenoid coil 114 is energized by providing current to the terminals 122. The bobbin 112 of the solenoid assembly is a spool on which the conductor of the solenoid coil 114 is wound. The bobbin 112 also defines a through hole in which an armature 172 is electromagnetically actuated as further described below.

Alternative embodiments of the actuator assembly 110 need not include the solenoid coil 114. For example, in an alternative embodiment, the actuator assembly is a piezoelectric actuator.

The valve assembly 160 of the air assist fuel injector 100 defines the dynamic portion of the air assist fuel injector 100 and includes the fuel injector nozzle 200 that discharges a plume of fuel from the air assist fuel injector 100. The fuel injector nozzle 200 includes a poppet 202 and body 204 against which the poppet abuts and in which the poppet reciprocates as described below. As illustrated in FIG. 2, the valve assembly 160 includes the armature 172, a poppet 202, a body 204, a leg 166, a spring 170, and a sleeve 168. The armature 172 is formed of a ferromagnetic material, such as 430 FR stainless steel or similar, and functions as the moving part of an electromagnetic actuator, defined by the solenoid coil 114 and armature 172 combination. As illustrated in FIG. 2, the armature 172 of the air assist fuel injector 100 is located relative to the solenoid coil 114 such that the armature 172 is subject to the lines of magnetic flux generated by the solenoid coil 114. Hence, the armature 172 is actuated when the solenoid coil 114 is energized.

The poppet 202 is attached to the armature 172, which is actuated by energizing the solenoid coil 114. In the illustrated embodiment, the armature 172 includes a cylindrical passageway located downstream of the passageway 180 and matingly receives a first end portion of the poppet 202. The first end portion of the poppet 202 is attached to the armature 172 with a welded connection, preferably a YAG laser weld. However, alternative attachments are also contemplated. For example, the poppet 202 may be attached to the armature 172 at any variety of locations with an interference fit, an adhesive, a threaded or screwed attachment, a lock-and-key attachment, a retaining ring attachment, an electron beam weld, an ultrasonic weld, or other known attachments. Because the poppet 202 is attached to the armature 172, the poppet 202 will move with the armature 172 when the armature is actuated by energizing the solenoid coil 114.

Figure 3:
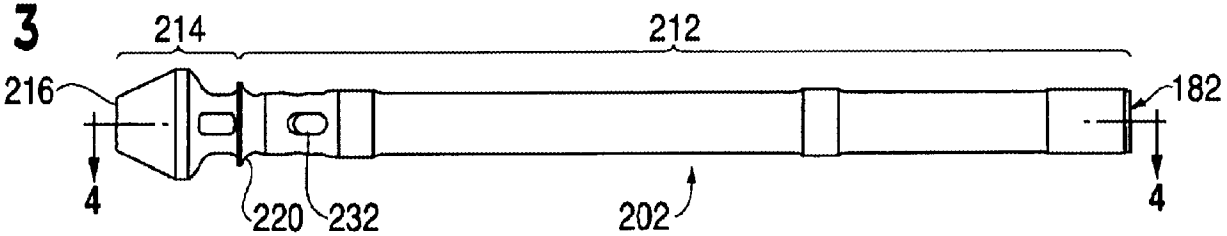
FIG. 3 is side view of the poppet illustrated in FIG. 1, where the head of the poppet includes a plurality of rectangular ducts.
Figure 4:
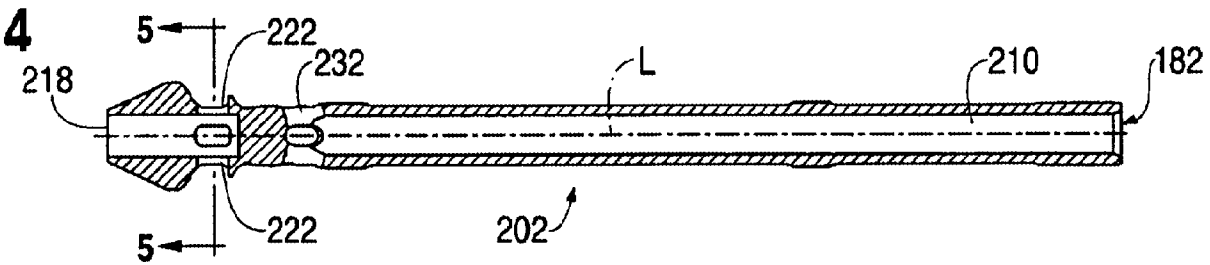
FIG. 4 is a cross-sectional view of the poppet illustrated in FIG. 3 taken along the line 4—4 in FIG. 3.
Figure 5:
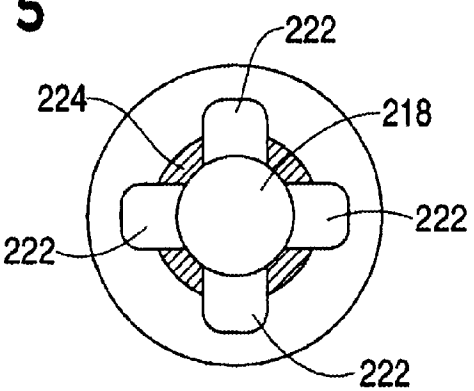
FIG. 5 is a cross-sectional view of the head of the poppet illustrated in FIG. 3 taken along the line 5—5 in FIG. 4.
Figure 6:
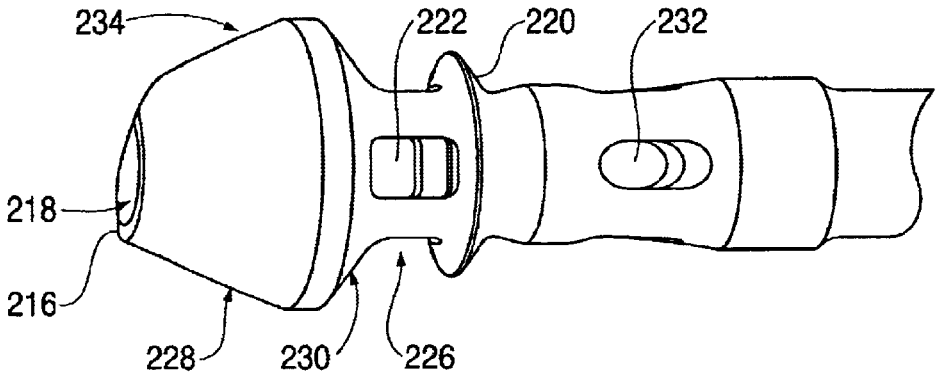
FIG. 6 is a partial and enlarged view of the head end of the poppet illustrated in FIG. 3.

The poppet 202 of the air assist fuel injector 100 is illustrated in further detail in FIGS. 3–7. The poppet 202 is a member that opens and closes to control the discharge of fuel from the fuel injector nozzle 200. When the poppet 202 opens and closes, it reciprocates in a channel 208 of the body 204. The body 204 is any physical object in which the poppet 202 reciprocates. In the illustrated embodiment, the poppet 202 includes a stem 212 and a head 214. The head 214 includes an impact surface 220 that abuts the body 204 when the fuel injector nozzle 200 is closed and that is spaced away from the body 204 when the fuel injector nozzle 200 is open. The impact surface 220 is located at a position typically referred to as the "gage line." As illustrated in FIG. 3, the head 214 extends from a tip 216 located at a most proximal end of the head to the impact surface 220 located at a most distal end of the head. In the preferred embodiment, the impact surface 220 includes an angled and annular face that defines a contact ring, which, as illustrated in FIG. 2, contacts a surface of the body 204 to define a seal between the poppet 202 and the body 204. The poppet 202 is preferably fabricated from a metallic material, such as stainless steel, but may be fabricated from other materials or combinations of materials, such as composites and ceramics.

As is also illustrated in FIGS. 3–7, the preferred embodiment of the poppet 202 includes a bulbous portion 234. The bulbous portion 234 is a portion of the head that is enlarged with respect to another portion of the head 214 and that affects the trajectory of the plume of fuel that exits the fuel injector nozzle 200. In the illustrated embodiment, the bulbous portion 234 includes a first truncated conical portion 228 converging toward the proximal end of the head 214 and a second truncated conical portion 230 converging toward the distal end of the head. As will be appreciated, the bulbous portion 234 may take many different shapes and still be within the confines of the present invention. For example, the bulbous portion 234 may only include one truncated conical portion 230. In addition, the poppet 202 need not include the bulbous portion 234. For example, in an alternative embodiment, the head 214 converges to a point downstream of the impact surface 220 with respect to the direction of flow f. Alternatively, the head 214 may only diverge or be entirely cylindrical. The head 214 further includes a necked portion 226 located between the impact surface 220 and the tip 216, and that has a smaller cross-sectional area than the largest cross-sectional area of the impact surface 220 and the largest cross-sectional area of the bulbous portion 234, as measured along planes transverse to the longitudinal counter axis L.

Figure 7:
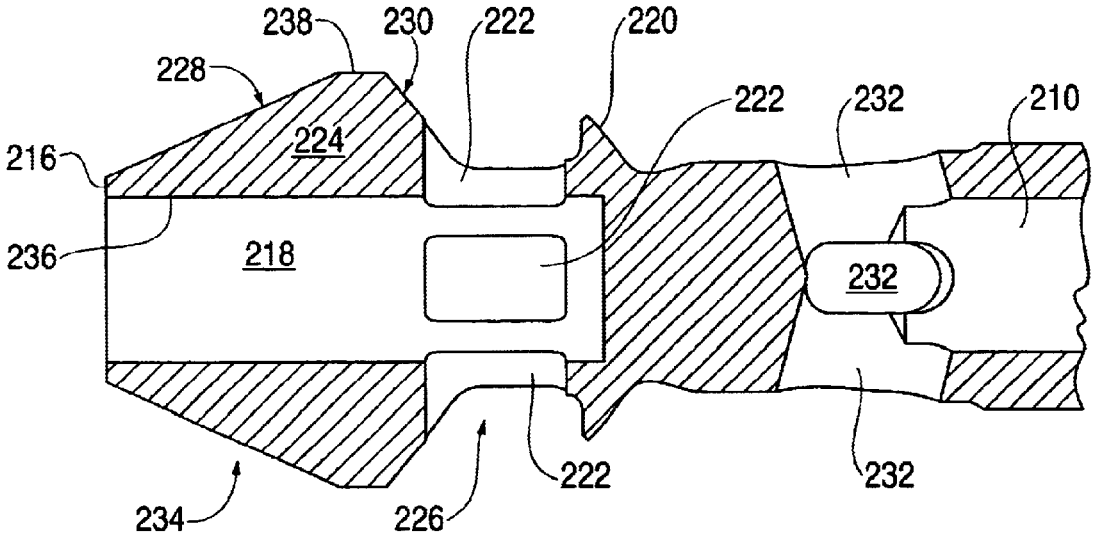
FIG. 7 is a partial and cross-sectional view of the head end of the poppet illustrated in FIG. 3.

A best illustrated in FIG. 7, the head 214 includes hollow interior 218, which is a space, recess, or cavity defined by an interior surface 236 within the periphery of the head. In the illustrated embodiment, the hollow interior 218 is a cylindrical bore that extends from the tip 216 to a location within the head at near or at the impact surface 220. The hollow interior 218 may take other forms. For example, an interior surface 236 of the head may follow the contour of the exterior surface 238 of the head 214 and may extend to other depths within the head, or even into the stem 212. Suitable configurations of the poppet head 214 are described in U.S. Pat. Nos. 5,551,638 and 5,833,142, the entire disclosures of which are hereby incorporate by reference.

As is also illustrated in FIGS. 1–7, the poppet head 214 further includes four ducts 222, which are tubes, canals, pipes, channels, passageways, or other conduits that communicate the hollow interior 218 with the area external of said head. In the illustrated embodiment, each duct 222 is a 2 mm×3 mm rectangular slot that passes though a wall 224 located between the exterior surface 238 and the interior surface 236. Hence, each duct 222 passes through at least a portion of the poppet 202 located between the impact surface 220 and the tip 216. The ducts 222 are each located transverse to a longitudinal center axis L of the stem 212 and are equally spaced from each other about the circumference of the necked portion 226. The ducts 222 are also separate from the hollow interior 218, i.e., the hollow interior 218 is not one of the ducts 222. In the preferred embodiment, the ducts 222 are located immediately downstream of the impact surface 220 with respect to the direction of flow f. In alternative embodiments, the poppet 202 may include more or fewer ducts 222 than those illustrated in FIGS. 3–7. For example, the poppet 202 may include one cylindrical duct or eight asymmetrically shaped ducts. As described further below, the ducts 222 help reduce the formation of deposits on the head of the poppet, especially at low fueling levels in specific applications.

The inlet 182 of the poppet 200 opens into an interior channel 210 that extends from the inlet 182 to an outlet 232 of the poppet 200 located upstream of the head 214. In the preferred embodiment, the poppet 200 includes four slot-shaped outlets 232 that are equally spaced from each other and located approximately transverse to a longitudinal axis L of the poppet 200. Although preferred that the poppet 200 have four slot-shaped outlets 232, other configurations will suffice. For example, the poppet 200 may include one slot-shaped outlet, two circular outlets, five oval outlets, or ten pin sized outlets. As described further below, alternative embodiments of the poppet 200 need not include the outlets 232 and the interior channel 210.

The impact surface 220 of the head 214 seats against the body 204 when the solenoid coil 114 is not energized. When the armature 172 is actuated by energizing the solenoid coil 114, the poppet 200 moves with the armature 172 such that the head 214 is lifted off of the body 204 in a direction away from the air assist fuel injector 100. Hence, the poppet 202 is an outwardly opening poppet. When the head 214 is lifted off of the body 204, a seal is broken between the head 214 and the body 204 such that liquid fuel and gas exiting the outlets 232 exits the air assist fuel injector 100.

Movement of the poppet 202 is guided by a bearing 175 between the poppet 202 and the body 204. The bearing 175 is located upstream of the outlets 232 with respect to the direction of flow f of the liquid fuel and the gas through the injector 100. Hence, the poppet 202 and the body 204 each include a bearing face for guiding movement of the poppet 202. Because the body 204 serves as a bearing surface for poppet movement and also absorbs the impact of the head 212 when the poppet 202 opens and closes, the body 204 is preferably fabricated from a wear and impact resistant material such as hardened 440 stainless steel. In alternative embodiments, the body 204 need not include a bearing surface that guides movement of the poppet. For example, movement of the poppet may be guided at other locations upstream of the body 204.

As further illustrated in FIG. 2, the poppet 202 moves within an elongated channel 165 of the leg 166. The leg 166 is an elongated body through which the poppet 200 moves and that supports the body 204. The interior channel 165 of the leg 166 through which the poppet 202 moves also serves as a secondary flow path for the pressurized gas. Hence, when the head 212 lifts off of the body 204, pressurized gas flows outside of the poppet 202 but inside the leg 166 to help atomize the liquid fuel and the gas exiting the outlets 232. As is apparent, the leg 166 and the body 204 may be formed from a single member. For example, the body 204 may define the same surfaces as the leg 166 and serve the same functions.

The spring 170 of the valve assembly 160 is located between the armature 172 and the leg 166. More particularly, the spring 176 is located within a recessed bore 171 that is concentric with the elongated channel 165 of the leg 166. The bore 171 faces the armature 172 and defines the seat for the spring 170. The spring 170 is a compression spring having a first end that abuts the armature 172 and a second end that abuts the leg 166. The bottom of the bore 171 defines the seat for the downstream end of the spring and a recess in the armature 172 defines a seat for the upstream end of the spring 170. The spring 170 functions to bias the armature 172 away from the leg 166. When the solenoid coil 114 is not energized, the spring 170 biases the armature 172 away from the leg 166 and thus the poppet 202 is maintained in a closed position where the head 214 abuts against the body 204. However, when the solenoid coil 114 is energized, the electromagnetic forces cause the armature 172 to overcome the biasing force of the spring 170 such that the armature 172 moves toward the leg 166 until it abuts a stop surface 167 of the leg 166. When the solenoid coil 114 is de-energized, the electromagnetic force is removed and the spring 170 again forces the armature 172 away from the stop surface 167.

The air assist fuel injector 100 also includes a cap 190 that defines an inlet to the air assist fuel injector 100 for the pressurized gas and liquid fuel. The cap 190 serves to direct the liquid fuel and gas to the passageway 180 of the armature 172. As illustrated in FIG. 2, the cap 190 includes one fuel passageway 192 having an inlet that primarily receives liquid fuel and four gas passageways 194 each having an inlet that primarily receives pressurized gas. The liquid fuel passageway 192 is located along the center axis of the cap 190, and the gas passageways 194 are circumferentially and equally spaced about the liquid fuel passageway 192. Alternative embodiments of the air assist fuel injector 100 need not include the cap 190, and alternative embodiments of the cap 190 may include more or fewer passageways 192, 194.

The air assist fuel injector 100 utilizes pressurized air to atomize low pressure fuel. When installed in an engine, the air assist fuel injector 100 is located such that the atomized low pressure fuel that exits the air assist fuel injector 100 is delivered to the internal combustion chamber of an engine, i.e., that part of an engine at which combustion takes place, normally the volume of the cylinder between the piston ground and the cylinder head, although the combustion chamber may extend to a separate cavity outside this volume. For example, the air assist fuel injector may be located in a cavity of a four-stroke internal combustion engine head such that the air assist fuel injector can deliver a metered quantity of atomized liquid fuel to a combustion cylinder to the four-stroke internal combustion engine where it is ignited by a spark plug or otherwise.

In a typical configuration, the air assist fuel injector 100 is located adjacent a conventional fuel injector (not illustrated), which delivers metered quantities of fuel to the air assist fuel injector. The conventional fuel injector may be located in the cavity of a rail or within a cavity in the head of an engine, such as disclosed in U.S. patent application Ser. No. 09/783,993, the entire disclosure of which is incorporated by reference. The air assist fuel injector 100 is referred to as "air assist" because it preferably utilizes pressurized air to atomize liquid fuel. Although it is preferred that the air assist fuel injector 100 atomize liquid gasoline with pressurized air, it will be appreciated that the air assist fuel injector 100 may atomize many other liquid combustible forms of energy with any variety of gases. For example, the air assist fuel injector 100 may atomize kerosene or liquid methane with pressurized gaseous oxygen, propane, or exhaust gas. Hence, the term "air assist" is a term of art, and is used herein and is not intended to dictate that the air assist fuel injector 100 be used only with pressurized air.

As described above, deposits tend to form on the head of fuel injectors, especially at low fueling levels. The embodiments of the present invention strive to address this problem by including one or more of the ducts 222 in the head 214 of the poppet 202. Generally speaking, deposits tend to form at a location immediately downstream of the impact surface 220 with respect to the direction of flow f. By including the ducts 222 in the head 214, deposits are less likely to form on the head as compared to some conventional configurations, resulting in a more reliable and consistently shaped plume of injected fuel. This will also help assure more consistent metering of fuel in embodiments where the poppet 202 is part of a fuel injector that acts as a metering device.

FIGS. 8–20 illustrate poppets 1202, 2202, 3202, 4202, 5202 in accordance with alternative embodiments of the present invention that may be used within the air assist fuel injector 100 or other fuel injectors, as described further below. The foregoing discussion of the benefits and functions of the poppet 202 also applies to the poppets 1202, 2202, 3202, 4202, and 5202. Thus, the poppets illustrated in FIGS. 8–20 have been assigned corresponding reference numbers as the poppet 202, increased by thousands. The poppets illustrated in FIGS. 8–20 also include additional features and inherent functions, as described further below.

Figure 8:
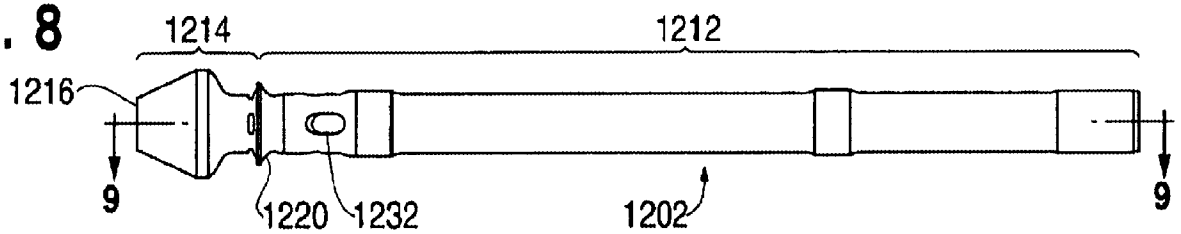
FIG. 8 is side view of an alternative embodiment of a poppet in accordance with the present invention, where the head of the poppet includes a plurality of elongated ducts.
Figure 9:
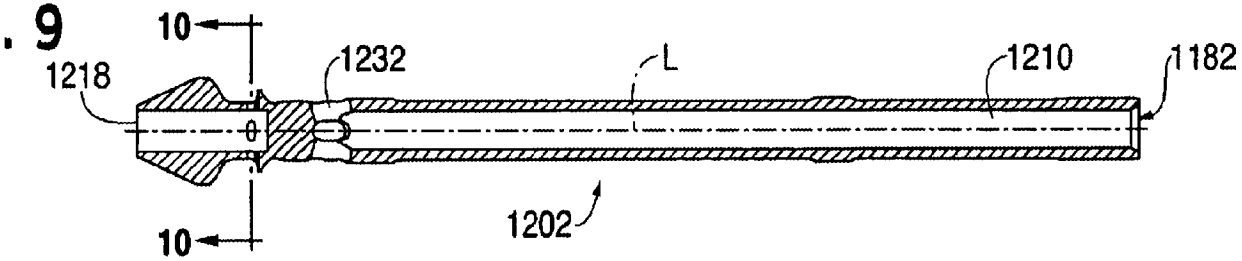
FIG. 9 is a cross-sectional view of the poppet illustrated in FIG. 8 taken along the line 9—9 in FIG. 8.
Figure 10:
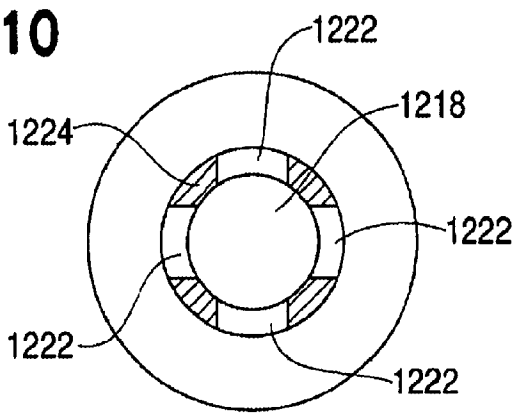
FIG. 10 is a cross-sectional view of the head of the poppet illustrated in FIG. 8 taken along the line 10—10 in FIG. 9.
Figure 11:
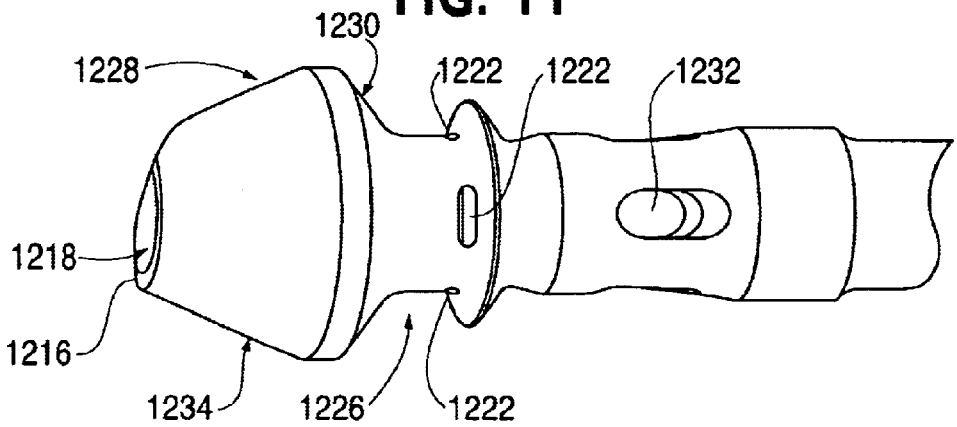
FIG. 11 is a partial and enlarged view of the head end of the poppet illustrated in FIG. 8.
Figure 12:
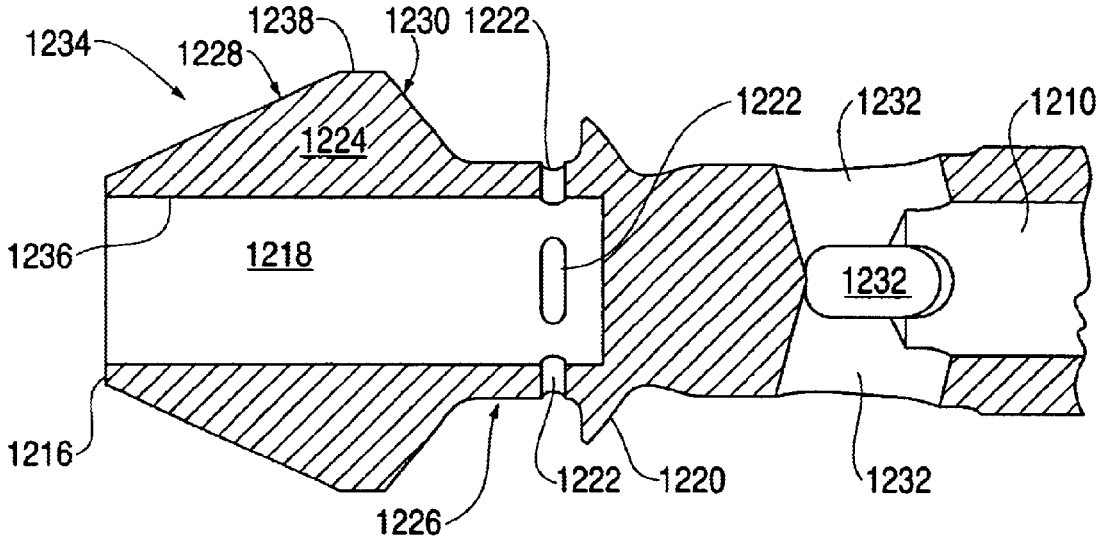
FIG. 12 is a partial and cross-sectional view of the head end of the poppet illustrated in FIG. 8.

As illustrated in FIGS. 8–12, the poppet 1202 includes a stem 1212 and a head 1214. The inlet 1182 of the poppet 1200 opens into an interior channel 1210 that extends from the inlet 1182 to an outlet 1232 of the poppet 1200 located upstream of the head 1214. The head 1214 includes an impact surface 1220 that abuts a body when a fuel injector nozzle is closed and that is spaced away from the body when the fuel injector nozzle is open. As illustrated in FIG. 8, the head 1214 extends from a tip 1216 located at a most proximal end of the head to the impact surface 1220 located at a most distal end of the head. The poppet 1202 includes a bulbous portion 1234 having a first truncated conical portion 1228 converging toward the proximal end of the head 1214 and a second truncated conical portion 1230 converging toward the distal end of the head. The head 1214 further includes a necked portion 1226 located between the impact surface 1220 and the tip 1216, and that has a smaller cross-sectional area than the largest cross-sectional area of the impact surface 1220 and the largest cross-sectional area of the bulbous portion 1234. The head 1214 includes a hollow interior 1218 and four slot-shaped ducts 1222 that communicate the hollow interior 1218 with the area external of the head. In the illustrated embodiment, the ducts 1222 are 0.50 mm×1.25 mm elongated slots that each pass though a wall 1224 located between the exterior surface 1238 and the interior surface 1236. The longer side of each rectangular duct 1222 is transverse to a longitudinal center axis L, and each duct 1222 passes through at least a portion of the poppet 1202 located between the impact surface 1220 and the tip 1216. The center axis of each duct 1222 is transverse to the longitudinal center axis L of the stem 1212, and the ducts are equally spaced from each other about the circumference of the necked portion 1226. The ducts 1222 are located immediately downstream of the impact surface 1220 with respect to the direction of flow f and help reduce the formation of deposits on the head of the poppet 1202.

Figure 13:
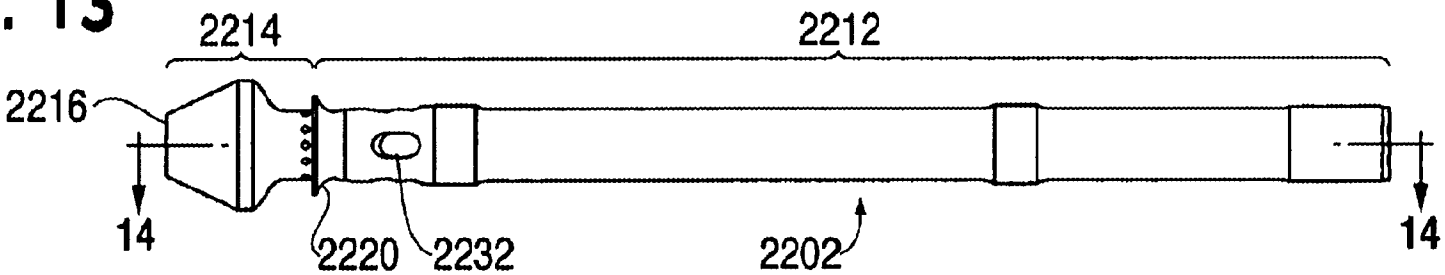
FIG. 13 is side view of another embodiment of a poppet in accordance with the present invention, where the head of the poppet includes a plurality of cylindrical ducts.
Figure 14:
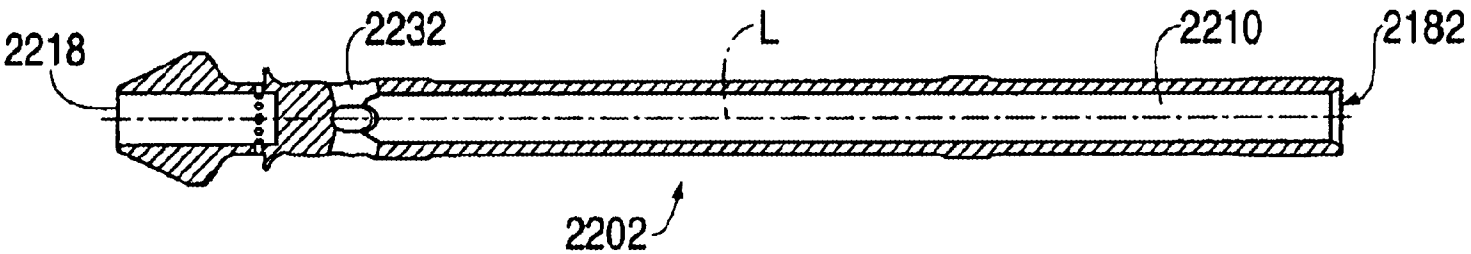
FIG. 14 is a cross-sectional view of the poppet illustrated in FIG. 13 taken along the line 14—14 in FIG. 13.
Figure 15:
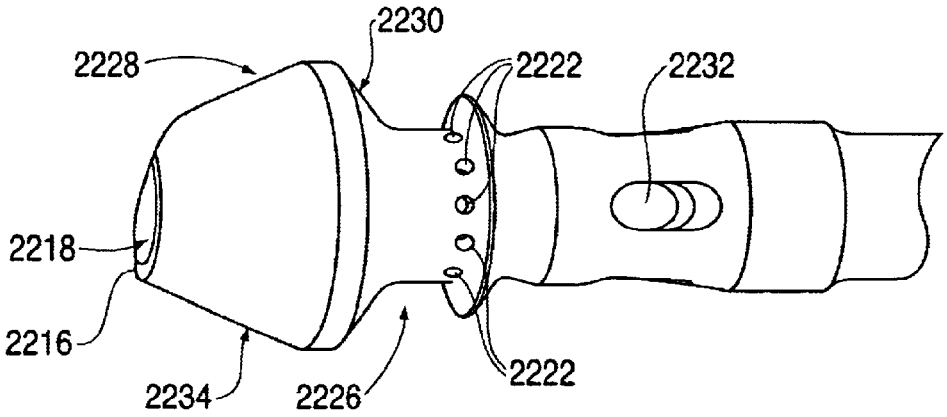
FIG. 15 is a partial and enlarged view of the head end of the poppet illustrated in FIG. 13.
Figure 16:
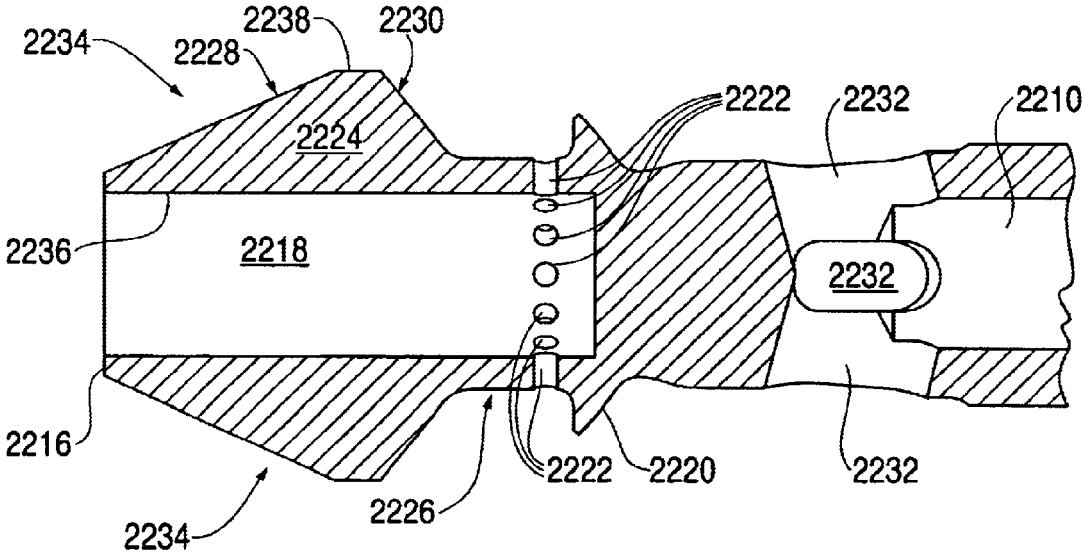
FIG. 16 is a partial and cross-sectional view of the head end of the poppet illustrated in FIG. 13.

As illustrated in FIGS. 13–16, the poppet 2202 includes a stem 2212 and a head 2214. The inlet 2182 of the poppet 2202 opens into an interior channel 2210 that extends from the inlet 2182 to an outlet 2232 of the poppet 2202 located upstream of the head 2214. The head 2214 includes an impact surface 2220 that abuts a body when a fuel injector nozzle is closed and that is spaced away from the body when the fuel injector nozzle is open. As illustrated in FIG. 13, the head 2214 extends from a tip 2216 located at a most proximal end of the head to the impact surface 2220 located at a most distal end of the head. The poppet 2202 also includes a bulbous portion 2234 having a first truncated conical portion 2228 converging toward the proximal end of the head 2214 and a second truncated conical portion 2230 converging toward the distal end of the head. The head 2214 further includes a necked portion 2226 located between the impact surface 2220 and the tip 2216, and that has a smaller cross-sectional area than the largest cross-sectional area of the impact surface 2220 and the largest cross-sectional area of the bulbous portion 2234. The head 2214 includes a hollow interior 2218 and twelve ducts 2222 that communicate the hollow interior 2218 with the area external of the head. In the illustrated embodiment, each duct 2222 is a 0.4 mm diameter cylinder that passes though a wall 2224 located between the exterior surface 2238 and the interior surface 2236. Each duct 2222 is transverse to a longitudinal center axis L, and each passes through at least a portion of the poppet 2202 located between the impact surface 2220 and the tip 2216. The center axis of each duct 2222 is transverse to the longitudinal center axis L of the stem 2212, and the ducts are equally spaced from each other about the circumference of the necked portion 2226. The ducts 2222 are located immediately downstream of the impact surface 2220 with respect to the direction of flow f and help reduce the formation of deposits on the head of the poppet 2202.

Figure 17:
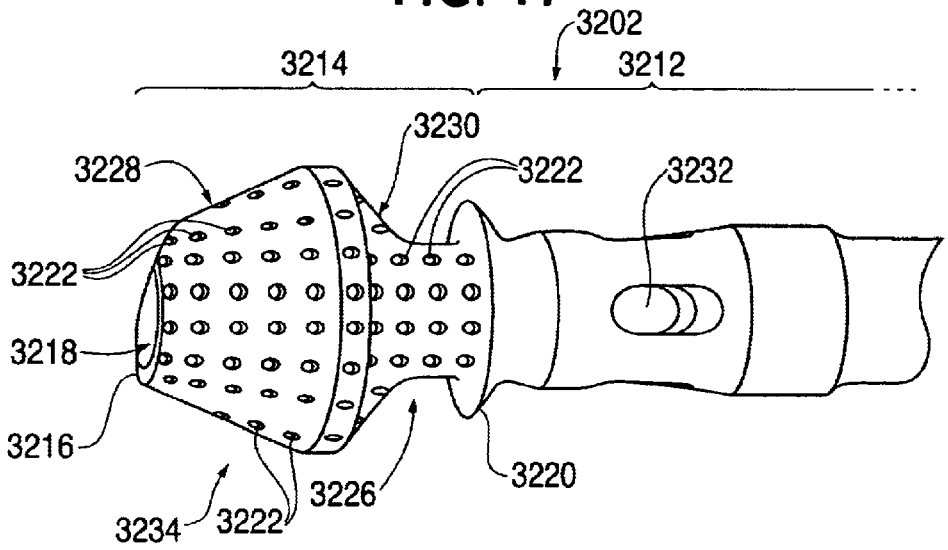
FIG. 17 is a partial and enlarged view of another embodiment of a poppet in accordance with the present invention.
Figure 18:
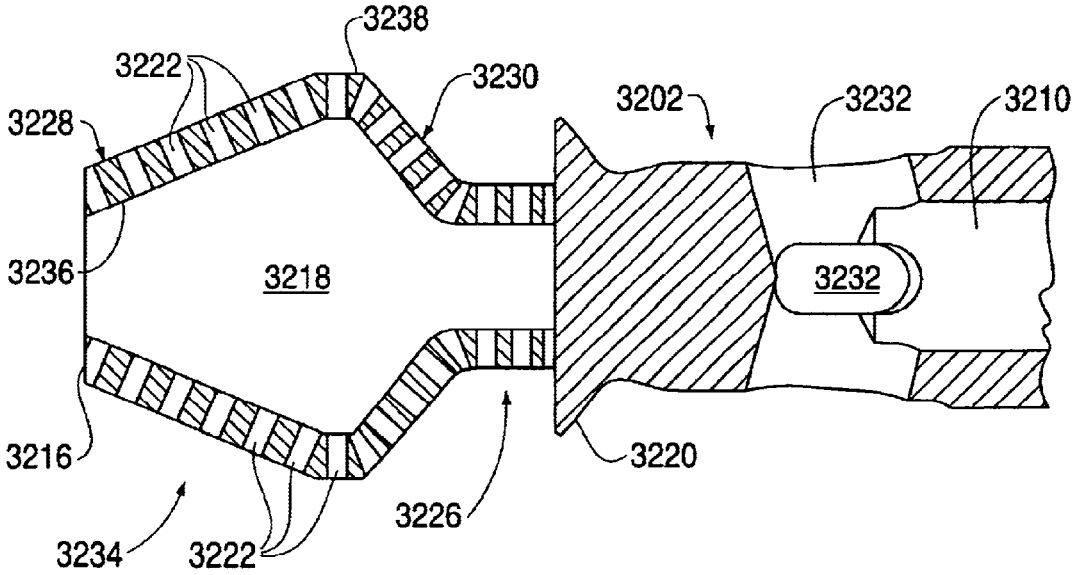
FIG. 18 is a partial and cross-sectional view of the poppet illustrated in FIG. 17.

As illustrated in FIGS. 17 and 18, the poppet 3202 includes a stem 3212 and a head 3214. The inlet of the poppet 3202 opens into an interior channel 3210 that extends from an inlet to an outlet 3232 of the poppet 3202 located upstream of the head 3214. The head 3214 includes an impact surface 3220 that abuts a body when a fuel injector nozzle is closed and that is spaced away from the body when the fuel injector nozzle is open. As illustrated in FIG. 17, the head 3214 extends from a tip 3216 located at a most proximal end of the head to the impact surface 3220 located at a most distal end of the head. The poppet 3202 includes a bulbous portion 3234 having a first truncated conical portion 3228 converging toward the proximal end of the head 3214 and a second truncated conical portion 3230 converging toward the distal end of the head. The head 3214 further includes a necked portion 3226 located between the impact surface 3220 and the tip 3216, and that has a smaller cross-sectional area than the largest cross-sectional area of the impact surface 3220 and the largest cross-sectional area of the bulbous portion 3234. The head 3214 includes a hollow interior 3218 and a plurality of cylindrical ducts 3222 located about a majority of an exterior surface 3238 of the head and that each communicate the hollow interior 3218 with the area external of the head. The head 3214 is perforated with ducts because it includes at least two ducts 3222. In the illustrated embodiment, each duct 3222 is a 0.3 mm diameter cylinder that passes through a wall 3224 located between the exterior surface 3238 and the interior surface 3236. The center axis of each duct 3222 is transverse to the contour followed by the exterior surface 3238, and each duct passes through at least a portion of the poppet 3202 located between the impact surface 3220 and the tip 3216. Adjacent ducts 3222 are equally spaced from each other at approximately 0.5 mm intervals about the entirety of the exterior surface 3228 located immediately downstream of the impact surface 3220.

As will be appreciated, the ducts 222, 1222, 2222, 3222 of the poppets 202, 1202, 2202, 3202 may be formed in the respective heads 214, 1214, 2214, 3214 by machining, laser drilling, molding, stamping, or by other techniques. As will also be appreciated, the majority of the exterior surface 3238 need not be perforated with the ducts 3222. For example, the sheet may be perforated only at locations where deposits tend to form during operation of a fuel injector, such as an annular area downstream of the impact surface 3220. The ducts 3222 also help reduce the formation of deposits on the head 3214 of the poppet 3202.

Figure 19:
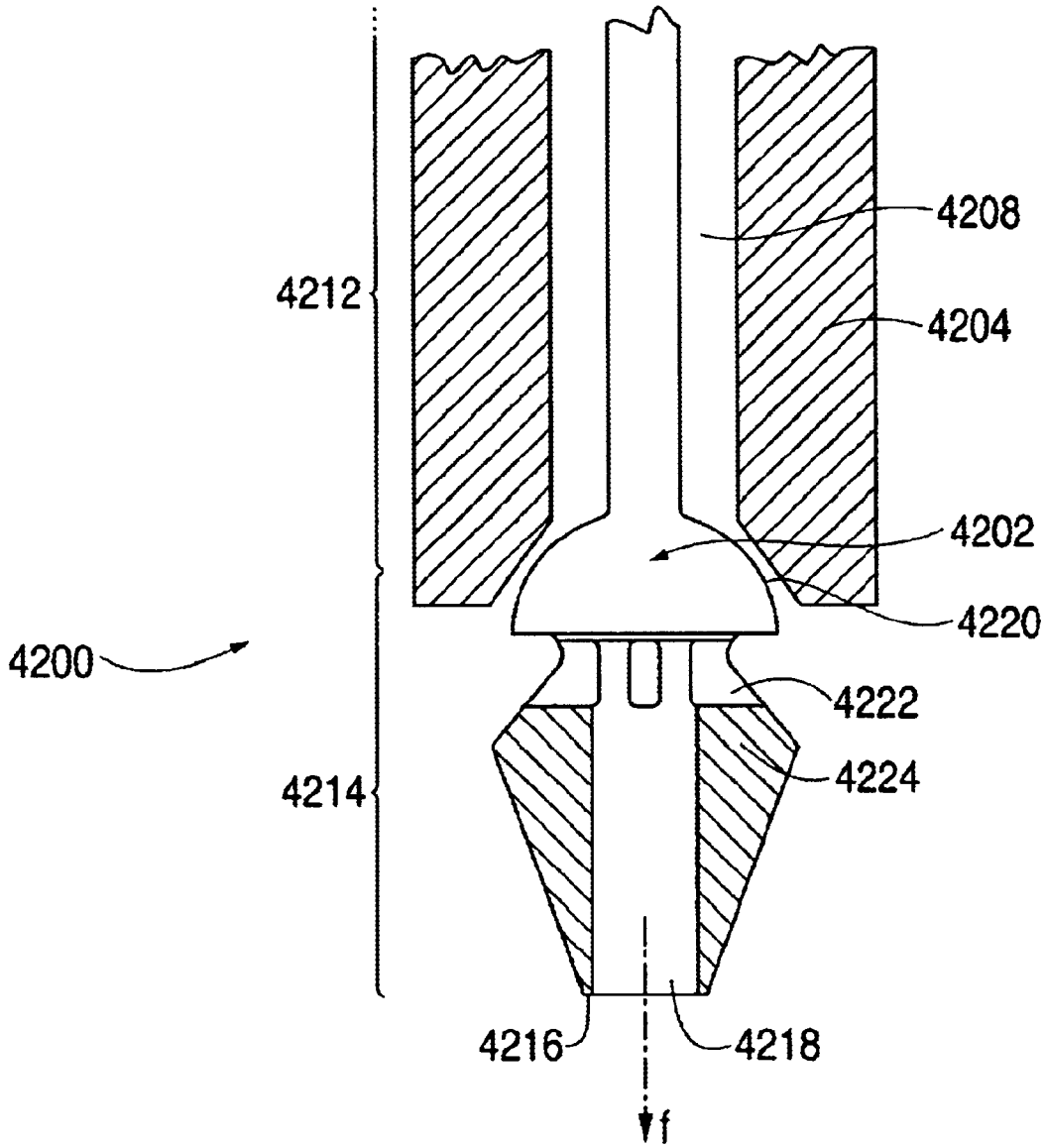
FIG. 19 is a partial and cross-sectional view of a fuel injector nozzle in accordance with a further embodiment of the present invention.
Figure 20:
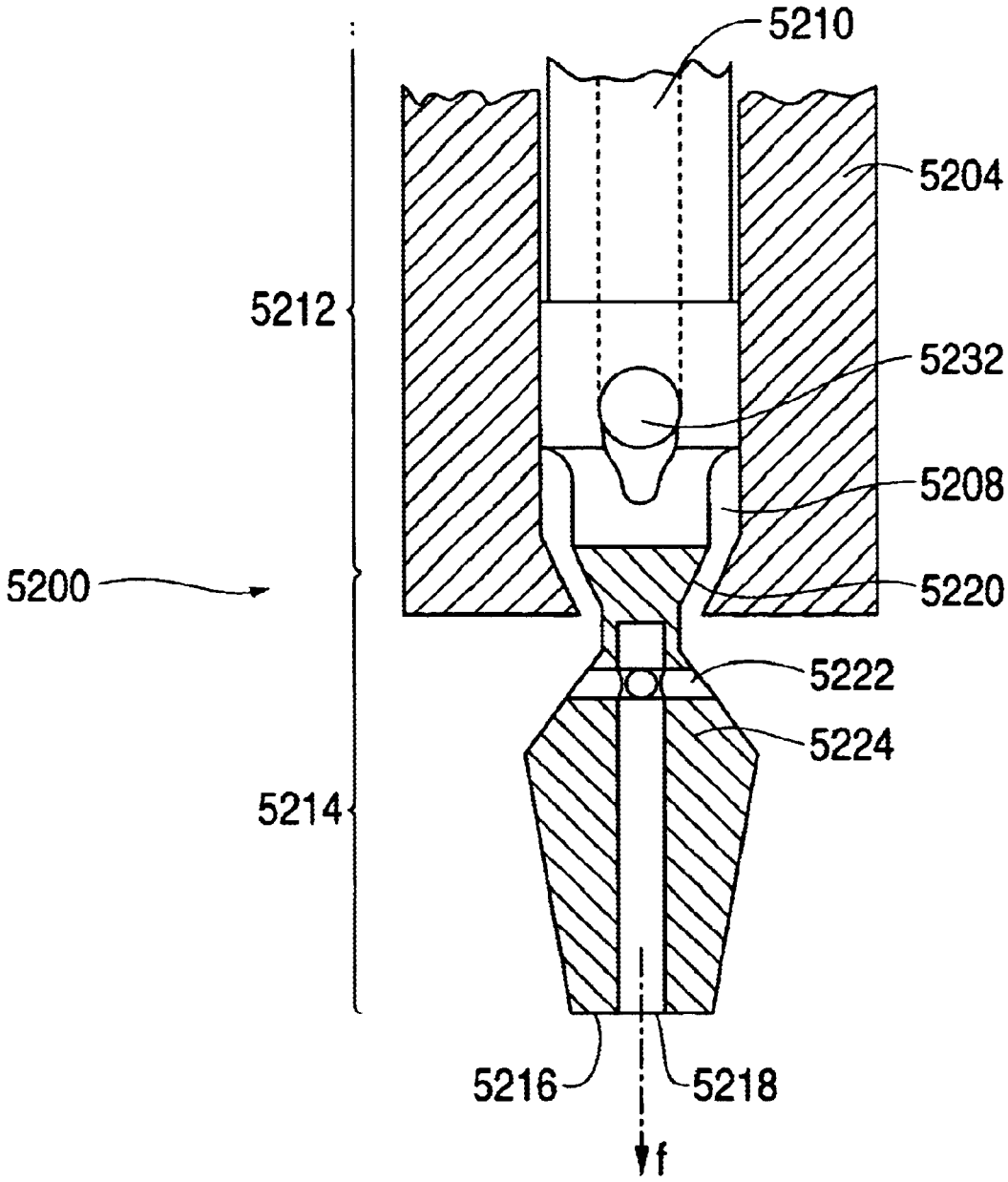
FIG. 20 is a partial and cross-sectional view of a fuel injector nozzle in accordance with another embodiment of the present invention.

FIGS. 19 and 20 illustrate alternative embodiments of fuel injector nozzles 4200, 5200 in accordance with the present invention. As illustrated in FIG. 19, the poppet 4200 includes a stem 4212 and a head 4214. Unlike the previously discussed poppets 200, 1200, 2200, 3200, the poppet 4202 does not include an inlet, and interior channel, or an outlet through which fuel is conveyed. Hence, the liquid fuel and/or gas travel outside the stem 4212 and in a channel 4208 of the body 4204. The head 4214 includes an impact surface 4220 that abuts a body when the fuel injector nozzle 4200 is closed and that is spaced away from the body when the fuel injector nozzle is open. The poppet 4202 is illustrated in the open position in FIG. 19. As illustrated in FIG.

19, the head 4214 extends from a tip 4216 located at a most proximal end of the head to the impact surface 4220 located at a most distal end of the head. The head 4214 includes a hollow interior 4218 and a plurality of ducts 4222 that pass through a wall 4224 and that each communicate the hollow interior 4218 with the area external of the head. The ducts 4222 help reduce the formation of deposits on the head of the poppet 4202.

As illustrated in FIG. 20, the poppet 5202 of the fuel injector nozzle 5200 includes a stem 5212 and a head 5214. The inlet of the poppet 5202 opens into an interior channel 5210 that extends from the inlet to an outlet 5232 of the poppet 5200 located upstream of the head 5214. The head 5214 includes an impact surface 5220 that abuts a body 5204 when the fuel injector nozzle 5200 is closed and that is spaced away from the body when the fuel injector nozzle is open. The poppet 5202 is illustrated in the open position in FIG. 20. As is apparent from FIG. 20, the poppet 5202 is an inwardly opening poppet 5202 that moves opposite the direction of flow f to open the fuel injector nozzle 5200 and discharge a plume of fuel; this is the opposite of the poppets 202, 1202, 2202, 3202, 4202, which are outwardly opening poppets that move in the direction of flow f to open the fuel injector nozzle and discharge a plume of fuel. As illustrated in FIG. 20, the head 5214 extends from a tip 5216 located at a most proximal end of the head to the impact surface 5220 located at a most distal end of the head. The head 5214 includes a hollow interior 5218 and a plurality of ducts 5222 that pass through a portion 5224 of the poppet and each communicate the hollow interior 5218 with the area external of the head. The ducts 5222 help reduce the formation of deposits on the head of the poppet 5202.

As will be appreciated, the poppets 202, 1202, 2202, 3202, 4202, 5202 may be used with fuel injector nozzles with differing constructions where fuel is discharged therefrom in the form of a plume, including inwardly and outwardly opening fuel injectors where fuel alone is injected and where fuel is entrained in a gas, such as air. Examples of specific nozzle constructions to which the poppets can be applied are disclosed in U.S. Pat. Nos. 5,090,625 and 5,593,095, the entire disclosures of which are hereby incorporated by reference.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A fuel injector nozzle comprising:

a poppet that is reciprocatable within a body to control the discharge of fuel from the fuel injector nozzle, the poppet comprising:

a stem;

a head having a tip, a hollow interior, an impact surface that impacts said body during operation of the fuel injector nozzle, and a duct separate from said hollow interior, passing through at least a portion of said head, communicating said hollow interior with an area external of said head, being located at least partially outside of said body, and being located at least partially between said tip and said impact surface.

2. The fuel injector nozzle of claim 1, said duct being substantially transverse to a longitudinal axis of said stem.

3. The fuel injector nozzle of claim 1, said duct including a cylindrical slot.

4. The fuel injector nozzle of claim 1, said duct including an elongated slot.

5. The fuel injector nozzle of claim 1, said impact surface including a contact ring.

6. The fuel injector nozzle of claim 1, said hollow interior including a cylindrical bore.

7. The fuel injector nozzle of claim 1, said head including a necked portion located between said tip and said impact surface.

8. The fuel injector nozzle of claim 7, said duct being located at said necked portion.

9. The fuel injector nozzle of claim 8, said head including a truncated conical portion located between said necked portion and said tip.

10. The fuel injector nozzle of claim 1, said duct being located adjacent said impact surface.

11. The fuel injector nozzle of claim 1, said stem including an internal channel.

12. The fuel injector nozzle of claim 11, said stem including an outlet that communicates an area external of said stem with said internal channel.

13. The fuel injector nozzle of claim 1, said duct being a first duct, further comprising a second duct, said second duct passing through at least another portion of said head, communicating said hollow interior with said area external of said head, and being located at least partially between said tip and said impact surface.

14. The fuel injector nozzle of claim 13, further comprising a third duct, said third duct passing through a further portion of said head, communicating said hollow interior with said area external of said head, and being located at least partially between said tip and said impact surface.

15. The fuel injector nozzle of claim 14, further comprising a fourth duct, said fourth duct passing through an additional portion of said head, communicating said hollow interior with said area external of said head, and being located at least partially between said tip and said impact surface.

16. The fuel injector nozzle of claim 1, said duct being one of a plurality of ducts that each communicate said hollow interior with said area external of said head and are each located at least partially between said tip and said impact surface.

17. The fuel injector nozzle of claim 1, in combination with a fuel injector.

18. The fuel injector nozzle of claim 17, said fuel injector being an air assist fuel injector.

19. A fuel injector nozzle, comprising:

a body having a channel in which an outwardly opening poppet is reciprocatable between a first position at which an impact surface of said poppet abuts against a surface of said body to prevent discharge of fuel from said fuel injector nozzle and a second position at which said impact surface is spaced away from said surface of said body to permit discharge of fuel from said fuel injector nozzle, said poppet having a plurality of ducts, each of said ducts being located downstream of said impact surface with respect to a direction of movement of said poppet away from said surface of said body, each of said ducts communicating a hollow interior of said poppet with an area external of said poppet.

20. The fuel injector nozzle of claim 19, each of said plurality of ducts being equidistantly spaced from each other.

21. The fuel injector nozzle of claim 19, each of said plurality of ducts being located radially about a longitudinal center axis of said poppet.

22. The fuel injector nozzle of claim 19, each of said plurality of ducts being equidistantly spaced from each other and located radially about a longitudinal center axis of said poppet.

23. The fuel injector nozzle of claim 19, said poppet including a bulbous portion located downstream of said impact surface with respect to said direction of movement and a necked portion located between said impact surface and said bulbous portion, said plurality of ducts being located at said necked portion.

24. The fuel injector nozzle of claim 23, said bulbous portion including a portion shaped like a truncated cone.

25. The fuel injector nozzle of claim 23, said hollow interior including a cylindrical bore located along a longitudinal center axis of said poppet and extending from a tip of said bulbous portion to a location adjacent said impact surface.

26. The fuel injector nozzle of claim 19, each of said plurality of ducts including an elongated slot.

27. The fuel injector nozzle of claim 19, each of said plurality of ducts including a cylindrical slot.

28. The fuel injector nozzle of claim 19, said plurality of ducts comprising at least four ducts.

29. The fuel injector nozzle of claim 19, said plurality of ducts comprising at least twelve ducts.

30. The fuel injector nozzle of claim 19, said plurality of ducts consisting of four ducts.

31. The fuel injector nozzle of claim 19, said plurality of ducts consisting of twelve ducts.

32. The fuel injector nozzle of claim 19, each of said plurality of ducts being located adjacent said impact surface.

33. The fuel injector nozzle of claim 19, said poppet including a internal channel.

34. A fuel injector nozzle, comprising:

a poppet having a stem and a head having a tip, a hollow interior, an impact surface that impacts a body of the nozzle during operation of the fuel injector nozzle, and means for communicating said hollow interior with an area external of said head at a location at least partially between said tip and said impact surface, said poppet being reciprocatable in said body to control the discharge of fuel from said fuel injector nozzle, said means for communicating being located at least partially outside of said body.

35. A fuel injector, comprising:

a poppet comprising:

an elongated stem having a longitudinal axis; and a head having a proximal end, a distal end located opposite from said proximal end, an impact surface at said distal end that impacts a body of the fuel injector during operation of the fuel injector, and a duct passing through at least a portion of said head at an angle substantially transverse to said longitudinal axis and at a location between said proximal end and said distal end, said poppet being reciprocatable within said body to control the discharge of fuel from said fuel injector, said duct being located at least partially outside of said body.

36. The fuel injector of claim 35, said duct being located adjacent said impact surface.

37. The fuel injector of claim 36, said duct being one of a plurality of ducts.

38. A fuel injector comprising:

a poppet comprising:

a stem; and a head having a wall defined by an exterior surface and an interior surface, said interior surface defining a hollow interior, said wall having a plurality of ducts passing therethrough, said fuel injector being configured such that fuel is not dischargeable from said fuel injector through said plurality of ducts when said fuel injector is injecting fuel.

39. The fuel injector of claim 38, said poppet being an outwardly opening poppet.

40. The fuel injector of claim 38, said wall having a proximal end portion and a distal end portion located opposite from said proximal end portion, said plurality of ducts being located at intervals along a length of said wall between said distal end portion and said proximal end portion.

41. The fuel injector of claim 40, said intervals being equal intervals.

42. The fuel injector of claim 38, said plurality of ducts being spaced about a majority of said exterior surface.

43. The fuel injector of claim 38, a center axis of each of said plurality of ducts being substantially noncoplanar with a longitudinal axis of said stem.

44. The fuel injector of claim 38, said interior surface including a cylindrical surface.

45. The fuel injector of claim 38, said head including a necked portion.

46. The fuel injector of claim 45, said head including a bulbous portion.

47. A fuel injector nozzle, comprising:

a body having a channel in which an outwardly opening poppet is reciprocatable between a first position at which an impact surface of said poppet abuts against a surface of said body and a second position at which said impact surface is spaced away from said surface of said body, said poppet having a plurality of ducts, each of said ducts being located downstream of said impact surface with respect to a direction of movement of said poppet away from said surface of said body, each of said ducts communicating a hollow interior of said poppet with an area external of said poppet, said poppet including a bulbous portion located downstream of said impact surface with respect to said direction of movement and a necked portion located between said impact surface and said bulbous portion, said plurality of ducts being located at said necked portion.

48. The fuel injector nozzle of claim 47, said bulbous portion including a portion shaped like a truncated cone.

49. The fuel injector nozzle of claim 47, said hollow interior including a cylindrical bore located along a longitudinal center axis of said poppet and extending from a tip of said bulbous portion to a location adjacent said impact surface.

50. A fuel injector, comprising:

a poppet having an impact surface that is reciprocatable between an open position and a closed position to control the discharge of fuel from the fuel injector, said poppet having a plurality of ducts, each of said ducts being located downstream of said impact surface of said poppet with respect to a direction of flow of fuel through said fuel injector, each of said ducts communicating a hollow interior of said poppet with an area external of said poppet, said fuel injector being configured such that fuel is not dischargeable from said fuel injector through said plurality of ducts when said fuel injector is injecting fuel.

51. A reciprocatable poppet for controlling the discharge of fuel from a fuel injector, comprising:

a stem;

a head having a tip, a hollow interior, an impact surface, and a duct separate from said hollow interior, passing through at least a portion of said head, communicating said hollow interior with an area external of said head, and being located at least partially between said tip and said impact surface, said head including a necked portion located between said tip and said impact surface, said duct being located at said necked portion, said head including a truncated conical portion located between said necked portion and said tip.

52. A reciprocatable poppet for controlling the discharge of fuel from a fuel injector, comprising:

a stem;

a head having a tip, a hollow interior, an impact surface, and a duct separate from said hollow interior, passing through at least a portion of said head, communicating said hollow interior with an area external of said head, and being located at least partially between said tip and said impact surface, said duct being located adjacent said impact surface.

* * * * *